US008318049B2

(12) United States Patent
Kim et al.

(10) Patent No.: US 8,318,049 B2
(45) Date of Patent: Nov. 27, 2012

(54) COMPOSITION FOR FORMING ELECTRON EMISSION SOURCE, ELECTRON EMISSION SOURCE INCLUDING THE COMPOSITION, METHOD OF PREPARING THE ELECTRON EMISSION SOURCE, AND FIELD EMISSION DEVICE INCLUDING THE ELECTRON EMISSION SOURCE

(75) Inventors: Yong-chul Kim, Seoul (KR); In-taek Han, Seoul (KR); Ho-suk Kang, Seoul (KR)

(73) Assignee: Samsung Electronics Co., Ltd. (KR)

( * ) Notice: Subject to any disclaimer, the term of this patent is extended or adjusted under 35 U.S.C. 154(b) by 229 days.

(21) Appl. No.: 12/495,159

(22) Filed: Jun. 30, 2009

(65) Prior Publication Data

US 2010/0079051 A1 Apr. 1, 2010

(30) Foreign Application Priority Data

Sep. 30, 2008 (KR) ..... 10-2008-0096025

(51) Int. Cl.
*H01B 1/04* (2006.01)

(52) U.S. Cl. ..... 252/503; 252/510; 252/511; 313/1; 313/235; 313/309; 313/310; 313/495

(58) Field of Classification Search ..... 252/503, 252/511, 510; 313/1, 235, 310, 311, 495, 313/309; 445/51
See application file for complete search history.

(56) References Cited

U.S. PATENT DOCUMENTS

| | | | | |
|---|---|---|---|---|
| 6,858,981 | B2 * | 2/2005 | Cho et al. | 313/495 |
| 7,755,264 | B2 * | 7/2010 | Nam et al. | 313/310 |
| 2004/0066132 | A1 * | 4/2004 | Cho et al. | 313/495 |
| 2005/0179355 | A1 * | 8/2005 | Yoo et al. | 313/311 |
| 2005/0189860 | A1 * | 9/2005 | Nam et al. | 313/311 |
| 2006/0238095 | A1 * | 10/2006 | Nam | 313/311 |

FOREIGN PATENT DOCUMENTS

| | | |
|---|---|---|
| JP | 2004-349187 | 12/2004 |
| JP | 2007-200564 | 8/2007 |
| JP | 2008-097842 | 4/2008 |
| KR | 10-2006-0095595 | 9/2006 |
| KR | 10-2007-0104809 | 10/2007 |

OTHER PUBLICATIONS

Yong C. Kim et al., Fomulation of Carbon Nanotube Paste and Its Optimization for Field Emission Display Applications, Asis Display/IMID '04 Digest, pp. 696-699.

* cited by examiner

*Primary Examiner* — Khanh Tuan Nguyen
(74) *Attorney, Agent, or Firm* — Cantor Colburn LLP

(57) ABSTRACT

An electron emission source includes nano-sized acicular materials and a cracked portion formed in at least one portion of the electron emission source. The acicular materials are exposed between inner walls of the cracked portion. A method for preparing the electron emission source, a field emission device including the electron emission source, and a composition for forming the electron emission source are also provided in the present invention.

19 Claims, 6 Drawing Sheets

COMPOSITION FOR FORMING ELECTRON EMISSION SOURCE, ELECTRON EMISSION SOURCE INCLUDING THE COMPOSITION, METHOD OF PREPARING THE ELECTRON EMISSION SOURCE, AND FIELD EMISSION DEVICE INCLUDING THE ELECTRON EMISSION SOURCE

CLAIM OF PRIORITY

This application makes reference to, incorporates into this specification the entire contents of, and claims all benefits accruing under 35 U.S.C. §119 from an application earlier filed in the Korean Intellectual Property Office on Sep. 30, 2008, and there duly assigned Serial No. 10-2008-0096025.

BACKGROUND OF THE INVENTION

1. Field of the Invention

The present invention relates to an electron emission source, and more particularly, to a composition for forming an electron emission source, an electron emission source including the composition, a method of preparing the electron emission source, and a field emission device including the electron emission source.

2. Description of the Related Art

Carbon nanotubes (CNTs) are primarily used as electron emission sources of field emission devices.

Electron emission sources including CNTs may be prepared by, for example, a CNT growth method using chemical vapor deposition (CVD), a printing method using a paste containing CNT, or an electrophoresis deposition method. An electron emission source including CNTs is prepared through a post-treatment process for exposing the electron emission source to a surface of a substrate.

As an example of the post-treatment process described above, an activation method using an adhesive tape, liquid elastomer, laser, or elastic rubber is known. More particularly, the post-treatment process includes coating a CNT paste on a substrate, sintering the CNT paste, and then ripping off or scrapping a surface of an electron emission source, or detaching a surface layer of an electron emission source to expose a CNT tip.

SUMMARY OF THE INVENTION

It is therefore an object of the present invention to provide an improved electron emission source and an improved method for preparing the electron emission source.

It is another object to provide an electron emission source with excellent electron emission ability even when the electron emission source is not prepared through a post-treatment process, a method of preparing the electron emission source, a field emission device including the electron emission source, and a composition for forming the electron emission source.

Additional aspects will be set forth in part in the description which follows and, in part, will be apparent from the description, or may be learned by practice of the invention.

According to one aspect of the present invention, an electron emission source is constructed with nano-sized acicular materials and a cracked portion formed in at least one portion of the electron emission source. The acicular materials are exposed between inner walls of the cracked portion.

According to another aspect of the present invention, a field emission device is constructed with a substrate, a first electrode formed on the substrate, and a plurality of electron emission sources formed on the first electrode. Each of the plurality of electron emission sources includes nano-sized acicular materials and a cracked portion formed in at least one portion of the electron emission source. The acicular materials are exposed between inner walls of the cracked portion.

According to another aspect of the present invention, a composition for forming an electron emission source is provided with an acicular material, an oligomer, a crosslinkable monomer, an initiator, and a solvent. The amount of the initiator is in the range of about 5 to about 50 parts by weight based on 100 parts by weight of the oligomer.

According to a further aspect of the present invention, a method for preparing an electron emission source includes forming a composition for an electron emission source on an electrode, drying the composition formed on the electrode, and heat treating the dried composition.

The method may further include exposing the dried product to light, after the drying process.

BRIEF DESCRIPTION OF THE DRAWINGS

A more complete appreciation of the inventive principles, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
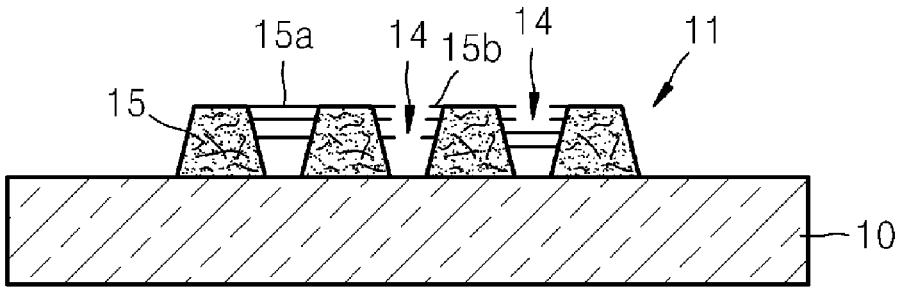
FIG. 1 is a cross-sectional view illustrating a cathode structure of an electron emission source constructed as an embodiment according to the principles of the present invention.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. Like reference numerals in the drawings denote like elements, and the size or thickness of each element may be exaggerated for clarity).

FIG. 1 is a cross-sectional view illustrating a structure of an electron emission source 11 constructed as an embodiment according to the principles of the present invention.

Referring to FIG. 1, electron emission source 11 constructed as the current embodiment according to the principles of the present invention is formed on a substrate 10, and includes a plurality of acicular materials 15. Substrate 10 may be a glass substrate, but is not limited thereto. Acicular materials 15 are nano-sized materials, and may be, for example, carbon nanotubes (CNTs), ZnO nanowires, or metal wires. An aspect ratio of acicular materials 15 may be in the range of about 1:50 to about 1:10,000. In addition, electron emission source 11 may include an organic residue in addition to acicular materials 15. In the specification and the claims, the organic residue refers to, unless otherwise specified, a solid residue remaining after an organic compound except for the acicular material is heat treated. During formation of the electron emission source, the composition for forming the electron emission source is heat treated, and the organic residue remains after the organic compound included in the composition for forming the electron emission source is heat treatment. In addition, if necessary, when a filler is used in preparing the composition for forming an electron emission source, electron emission source 11 may further include the filler.

In the present embodiment, a cracked portion 14 (that is, a crack) is formed in at least one portion of electron emission source 11, and acicular materials 15*a* and 15*b* are exposed between inner walls 13 of cracked portion 14. Acicular materials 15*a* and 15*b* exposed between inner walls 13 of cracked portion 14 may include very pure carbon nanotubes (CNTs), ZnO nanowires or metal wires. Cracked portion 14 may be formed to have a width in the range of about 1 μm to about 20 μm, but is not limited thereto. In one embodiment according to the principles of the present invention, the cracked portion may be formed to have a width in the range of about 1 μm to about 10 μm. In another embodiment according to the principles of the present invention, the cracked portion may be formed to have a width of more than 2 μm. Acicular materials 15*a* and 15*b* exposed between inner walls 13 of cracked portion 14 may be in the form of a bridge 15*a* that connects inner walls 13 of cracked portion 14 or may be in the form of a tip 15*b* that protrudes from inner walls 13 of cracked portion 14. In addition, if acicular material 15*a* is in the form of a bridge and acicular material 15*b* is in the form of a tip, acicular material 15*a* and acicular material 15*b* may be formed together between inner walls 13 of cracked portion 14. In other words, acicular materials 15*a* in the form of bridges and the acicular materials 15*b* in the form of tips may co-exist in the same cracked portion 14.

In electron emission source 11 in which cracked portion 14 is formed in at least one portion of electron emission source 11 and acicular materials 15*a* and 15*b*, which may be pure, are exposed between inner walls 13 of cracked portion 14 as described above, field emission capability can be improved even when a post-treatment process, such as an activation process using a tape, is not performed. Thus, current density may be increased and electron emission current stability may also be improved.

Figure 2A:
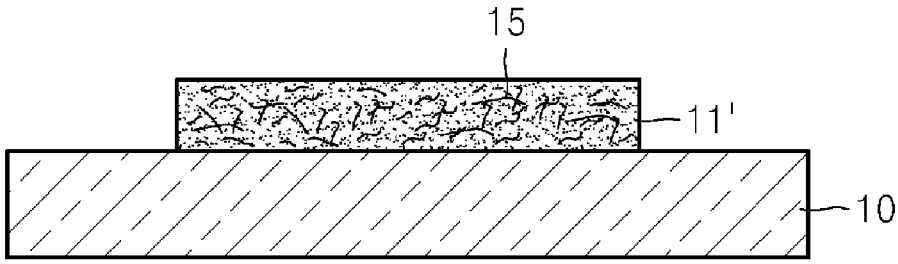
FIGS. 2A through 2C are cross-sectional views illustrating a method for preparing the electron emission source as an embodiment according to the principles of the present invention.
Figure 2B:
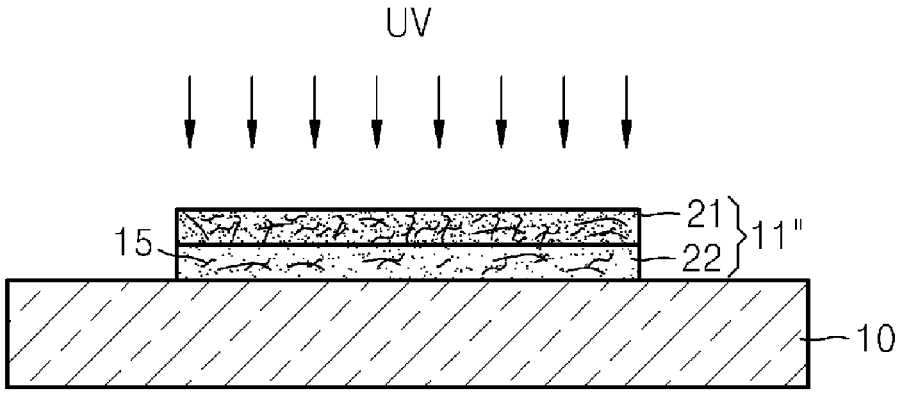
Figure 2C:
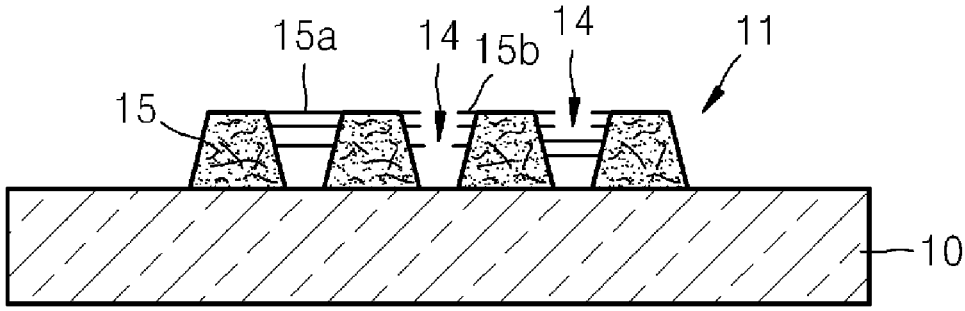

Hereinafter, a method for preparing the electron emission source illustrated in FIG. 1 will be described. FIGS. 2A through 2C are cross-sectional views illustrating a method for preparing the electron emission source as an embodiment according to the principles of the present invention.

Referring to FIG. 2A, first, a composition 11' for forming an electron emission source is prepared, wherein composition 11' includes a nano-sized acicular material 15. Acicular material 15 may be carbon nanotubes, ZnO nanowires, or metal wires. In this regard, acicular material 15 may have an aspect ratio in the range of about 1:50 to about 1:10,000. A detailed description of a composition of composition 11' for forming the electron emission source will be described later. Subsequently, composition 11' for forming the electron emission source is formed on substrate 10. According to an embodiment of the present invention, the composition 11' is screen-printed on substrate 10. Then, composition 11' for forming an electron emission source is dried. In this regard, the drying process may be performed at a temperature in the range of about 90° C. to about 120° C. The drying time may be in the range of about 10 minutes to about 20 minutes. The drying time may vary, however, according to the drying temperature.

Next, dried composition 11' is heat treated to obtain electron emission source 11 in which cracked portion 14 is formed in at least one portion of electron emission source 11 and nano-sized pure acicular materials 15*a* and 15*b* are exposed between inner walls 13 of cracked portion 14, as illustrated in FIG. 2C. The width of cracked portion 14 formed in this process may be in the range of about 1 μm to about 20 μm, but is not limited thereto. In one embodiment according to the principles of the present invention, the cracked portion may be formed to have a width in the range of about 1 μm to about 10 μm. In another embodiment according to the principles of the present invention, the cracked portion may be formed to have a width of more than 2 μm.

The heat treatment process may be performed at a temperature in the range of about 400° C. to about 470° C. The heat treatment time, although it may vary according to the heat treatment temperature, may be in the range of about 20 to about 60 minutes. When the heat treatment temperature is less than 400° C., a lot of residue organic materials may remain, and thus emission properties of electron emission source 11 may deteriorate. On the other hand, when the heat treatment temperature is greater than 470° C., carbon-based materials for the electron emission source, such as CNTs may be oxidized. The heat treatment process is performed in an inert gas atmosphere such as a nitrogen gas, or an argon gas in order to minimize degradation of the carbon-based materials.

In addition, before the heat treatment process is performed, a process of exposing the dried composition 11' to light, as illustrated in FIG. 2B, may be further performed. In this process, the dried composition 11' may be exposed to UV radiation having a light exposure energy in the range of about 1 J/cm$^2$ to about 10 J/cm$^2$. Referring to FIG. 2B, the printed and dried resultant composition 11" is deposited on substrate 10, and includes a light exposure portion 21 that is exposed to the UV radiation, and a non-light exposure portion 22 that is not exposed to the UV radiation. As illustrated in FIG. 2B, light exposure portion 21 and non-light exposure portion 22 co-exist. When the resultant composition 11" is then heat treated to form electron emission source 11, cracked portion 14 is formed in electron emission source 11 due to a difference between thermal shrinkages of light exposure portion 21 and non-light exposure portion 22 (for example, because the thermal shrinkage of light exposure portion 21 is greater than the thermal shrinkage of non-light exposure portion 22), and acicular materials 15*a* and 15*b* are exposed between inner walls 13 of cracked portion 14, as illustrated in FIG. 2C. In this regard, when the type of acicular material 15 used in the preparation of composition 11' for forming an electron emission source and the width of cracked portion 14 are adjusted, acicular material 15*a* may take the form of a bridge that connects inner walls 13 of cracked portion 14 or acicular material 15*b* may take the form of a tip that protrudes from inner walls 13 of cracked portion 14. In addition, acicular material 15*a* in the form of a bridge and acicular material 15*b* in the form of a tip may be formed together between inner walls 13 of cracked portion 14.

UV-curing is a cross-linking process initiated by photoinitiator (PI) in the mixture of monomer and oligomer. Alternatively, this cross-linking process can be performed by a thermal process by using a thermal energy at over 250° C.

The advantages of the UV-curing process include that the UV-curing process is faster than the thermal process, and that selective patterns can be attainable through photolithography during the UV-curing process.

When cross-linking reactions are generated in an organic moiety, the generated chemical bonds in the organic moiety normally shrink. Thus, a controlled moiety with high degree of cross-linking can generate dense cracks during a thermal process over 250° C. Under the condition of adequate adhesion strength between substrate and paste, the cross-linking assisted crack forming can be uniformly achieved all over the printed region. Therefore, in one embodiment according to the principle of the present invention, an adhesion improver (i.e., an adhesion promoter) is added in the CNT paste. In the case without an adequate adhesion force, the cracked flakes may be detached from the substrate.

The thermal process may be more favourable than UV-curing the CNT paste because the CNTs may strongly absorb the UV, so that the light may hardly penetrate throughout the 10 μm thick printed layer of the CNTs. The UV intensity decays exponentially in the CNT paste by Beer-Lambert law. Contrarily, the thermal energy can be dosed uniformly into the CNT paste without limits.

Therefore, when the UV-curable CNT paste is formulated for crack formation, UV-exposure is optionally performed.

The electron emission source 11 illustrated in FIG. 2C may include acicular material 15*a* in the form of a bridge and acicular material 15*b* in the form of a tip, and an organic residue. In addition, if necessary, when a filler is used in preparing composition 11' for forming the electron emission source, electron emission source 11 may include the filler besides acicular material 15 and the organic residue. Acicular materials 15*a* and 15*b* exposed between inner walls 13 of cracked portion 14 of electron emission source 11 are pure materials, and may be carbon nanotubes, ZnO nanowires, or metal wires.

The amount of the organic residue on a surface of acicular materials 15*a* and 15*b* exposed between inner walls 13 of cracked portion 14 may be about 0.1 parts by weight or less, in particular, about 0.00001 to about 0.1 parts by weight based on the total weight of 100 parts by weight of acicular materials 15*a* and 15*b* at a temperature of about 450° C. in a nitrogen atmosphere. After the heat treatment and cracked processes, a change in the thickness of acicular material 15 may be within ±5%.

According to an embodiment of the principles of the present invention, a composition for forming an electron emission source includes an acicular material, an oligomer, a crosslinkable monomer, an initiator, and a solvent.

The amount of the initiator may be in the range of about 5 to about 50 parts by weight based on 100 parts by weight of the oligomer. The amount of the initiator is in the range of about 5 to about 20 parts by weight based on 100 parts by weight of the oligomer, according to an embodiment. When the amount of the initiator is less than 5 parts by weight based on 100 parts by weight of the oligomer, micro-crack formation in the finally obtained electron emission source may be insufficient. On the other hand, when the amount of the initiator is greater than 50 parts by weight based on 100 parts by weight of the oligomer, storage stability of the composition for forming an electron emission source may deteriorate.

The initiator absorbs light or radiation to generate radicals, thereby initiating a reaction. More particularly, the initiator initiates a crosslinking reaction of an acrylate-based oligomer and a (metha)acryl-based monomer in the exposure to light and/or the heat treatment processes in the process of preparing the electron emission source. Examples of the initiator may include at least one selected from the group consisting of α-hydroxy alkylphenone, acrylphosphine oxide, and benzophenone.

The α-hydroxy alkylphenone may be α-hydroxy cyclohexyl phenyl ketone, or hydroxy dimethyl acetophenone. The acrylphosphine oxide may be 2,4,6-tetramethylbenzoyl diphenyl phosphine oxide.

The oligomer may be a (metha)acryl-based compound having a viscosity of 1,000 cps (at 25° C.) or greater. Examples of the oligomer may include at least one selected from the group consisting of epoxy acrylate oligomer, urethane acrylate oligomer, polyester acrylate, acryl acrylate oligomer, polybutadiene acrylate, silicon acrylate oligomer, melamine acrylate oligomer, and dendritic polyester acrylate.

The epoxy acrylate oligomer may be phenylepoxy epoxy acrylate oligomer (Product Name: PE110, available from Miwon Commercial Co., Ltd.), bisphenol A epoxy diacrylate (Product Name: PE210, available from Miwon Commercial Co., Ltd.), aliphatic alkyl diacrylate (Product Name: PE230, available from Miwon Commercial Co., Ltd.), fatty acid modified epoxy acrylate (Product Name: PE240, available from Miwon Commercial Co., Ltd.), or aliphatic allyl epoxy triacrylate (Product Name: PE320, PE330, available from Miwon Commercial Co., Ltd.).

The urethane acrylate oligomer may be aliphatic urethane hexaacrylate (Product Name: PU600 (compound represented by Formula 2 below), PU610, available from Miwon Commercial Co., Ltd.).

The (metha)acryl-based oligomer may be a compound represented by Formula 1 or 2 below, which is one of the urethane acrylate oligomers, or a compound represented by Formula 3 below, which is one of the epoxy acrylate oligomers.

<Formula 1>

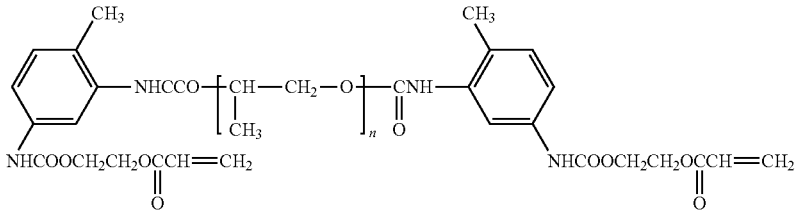

wherein n is an integer in the range of 1 to 15.

<Formula 2>

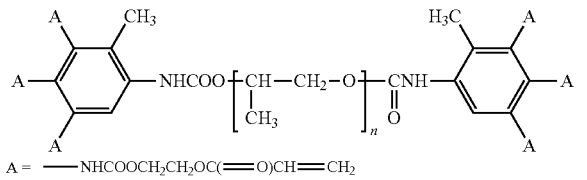

wherein n is an integer in the range of 1 to 15.

<Formula 3>

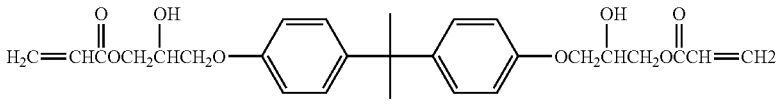

The compound represented by Formula 2 is a multi-functional urethane acrylate oligomer having 6 functional groups A. By using the multi-functional oligomer, cracks are uniformly formed on the entire region of the finally prepared electron emission source even though a smaller amount of an initiator is used when compared with other oligomers.

The crosslinkable monomer is crosslinking reacted with the oligomer described above, and may act as a reactive diluent. The crosslinkable monomer affects adhesion force, glass transition temperature, and mechanical properties of the finally obtained electron emission source.

The crosslinkable monomer may be an acryl-based compound, a methacryl-based compound, a compound having an allyl group or a vinyl group.

The acryl-based compound may be at least one selected from the group consisting of mono-functional acrylate, bi-functional acrylate, tri-functional acrylate, and higher-functional acylate.

The crosslinkable monomer may be propane-1,3-diol-2,2-bis (hydroxymethyl) triacrylate (penta-erythritol tri-acrylate, PETIA), or trimethylolpropane triacrylate (TMPTA).

The amount of the crosslinkable monomer may be in the range of about 5 to about 50 parts by weight based on 100 parts by weight of the oligomer. If the amount of the crosslinkable monomer is less than 5 parts by weight based on 100 parts by weight of the oligomer, cracks may not be formed in the finally obtained electron emission source. On the other hand, if the amount of the crosslinkable monomer is greater than 50 parts by weight based on 100 parts by weight of the oligomer, the storage stability of the composition for forming an electron emission source may deteriorate.

Examples of the acicular material include carbon nanotubes, and metal nanowires (for example, copper nanowires, ZnO nanowires).

The carbon nanotubes may be single-walled carbon nanotubes, double-walled carbon nanotubes, or multi-walled carbon nanotubes.

The amount of the acicular material may be in the range of about 1 to about 40 parts by weight based on 100 parts by weight of the oligomer. If the amount of the acicular material is less than 1 part by weight based on 100 parts by weight of the oligomer, emission properties of the electron emission source may deteriorate. On the other hand, if the amount of the acicular material is greater than 40 parts by weight based on 100 parts by weight of the oligomer, it may be difficult to disperse the acicular material in the composition for forming an electron emission source.

The solvent used in preparing the composition for forming an electron emission source may be terpineol, butyl carbitol, butyl carbitol acetate, toluene, or texanol. In this regard, terpineol is used as the solvent according to an embodiment of the present invention. The amount of the solvent may be in the range of about 10 to about 200 parts by weight based on 100 parts by weight of the oligomer. If the amount of solvent is not within this range, it may be difficult to uniformly disperse each of a plurality of components in the composition for forming an electron emission source and uniformly mix the components together.

The composition for forming the electron emission source may further include at least one assisting material selected from the group consisting of an additive, such as a binder resin, a filler, a levelling agent, an antifoaming agent, a stabilizer, or an adhesion improver, and a pigment. The total amount of the assisting materials may be in the range of about 0.1 to about 350 parts by weight based on 100 parts by weight of the oligomer.

The binder resin affects the viscosity and printing properties of the composition for forming an electron emission source, and may be a (metha)acryl-based polymer.

The (metha)acryl-based polymer may be a compound represented by Formula 4 below.

<Formula 4>

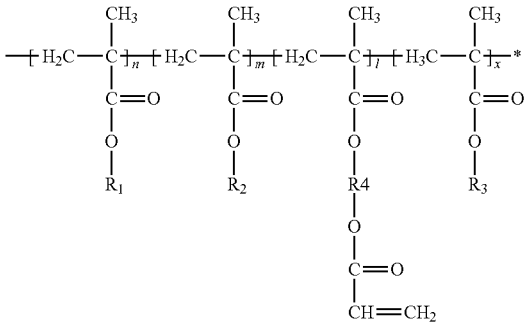

wherein n is in the range of 100 to 2000, m is in the range of 100 to 2000, 1 is in the range of 100 to 2000, x is in the range of 100 to 2000, $R_1$ is a $C_1$-$C_{10}$ alkyl group, $R_2$ is a $C_1$-$C_{10}$ alkyl group, $R_3$ is a methyl, epoxy, or urethane group, and $R_4$ is a $C_1$-$C_{10}$ alkylene group.

The amount of the binder resin may be equal to or less than 250 parts by weight, for example, in the range of about 0.1 to about 250 parts by weight, based on 100 parts by weight of the oligomer.

The filler may be tin oxide, indium oxide, metal (silver, aluminium, or palladium), silica, or alumina, and has an average particle diameter in the range of about 10 nm to about 1 μm. The amount of the filler may be in the range of about 10 to about 100 parts by weight based on 100 parts by weight of the oligomer.

According to another embodiment of the principles of the present invention, an electron emission source including the composition for forming the electron emission source described above is provided. The electron emission source has a low turn-on voltage, excellent emission properties, and excellent emission current stability, even though a post-treatment process, such as an activation process using a tape, is not performed on the electron emission source, as described above. Thus, equipment costs for the post-treatment process are decreased.

According to still another embodiment of the principles of the present invention, an electronic device including the electron emission source described above is provided. The electronic device may be a field emission display device, a backlight unit for a liquid crystal display device, an X-ray light source, an ion source, or a RF/MW amplifier.

Figure 3:
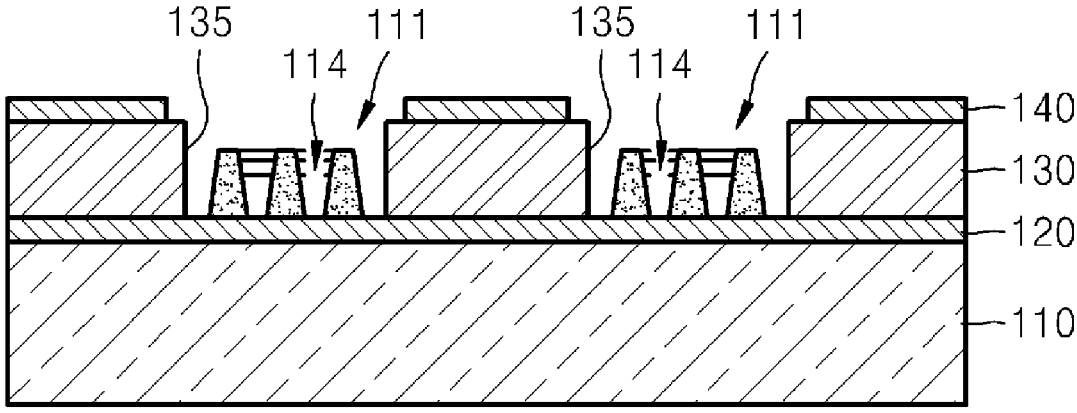
FIG. 3 is a cross-sectional view of a field emission device including an electron emission source and gate constructed as an embodiment according to the principles of the present invention.

FIG. 3 is a cross-sectional view of a field emission device including an electron emission source, according to an embodiment of the principles of the present invention. The field emission device refers to a device in which an electric field is formed around an electron emission source 111 so that electrons are released from electron emission source 111. The field emission device may be applied in a field emission display device or a backlight unit for a liquid crystal display device, which forms images such that electrons emitted from the filed emission device collide with a phosphor layer formed on an anode to emit light having a predetermined color.

Referring to FIG. 3, the field emission device according to the present embodiment may include a substrate 110, and a first electrode 120, insulating layer 130 and second electrode 140 that are sequentially formed on substrate 110. In this regard, a plurality of emitter holes 135 are formed in insulating layer 130 to expose first electrode 120, and electron emission sources 111 are formed in emitter holes 135.

Substrate 110 may be a general glass substrate, but is not limited thereto. First electrode 120 may include an electrically conductive material, such as indium tin oxide (ITO), and constitute a cathode. Second electrode 140 may include a conductive metal, such as Cr, and constitute a gate electrode.

Electron emission source 111 includes, as described above, a plurality of acicular materials 115 (refer to FIG. 1). In this regard, acicular materials 115 are nano-sized materials, and may be carbon nanotubes (CNTs), ZnO nanowires, or metal wires. Acicular materials 115 have an aspect ratio in the range of 1:50 to 1:10,000.

A cracked portion 114 is formed in at least one portion of electron emission source 111, and acicular material 115 is exposed between inner walls 113 of cracked portion 114. The width of cracked portion 114 may be in the range of about 1 μm to about 20 μm, but is not limited thereto.

Acicular materials 115 exposed between inner walls 113 of cracked portion 114 may include pure carbon nanotubes (CNTs), ZnO nanowires or metal wires. Acicular materials 115 exposed between inner walls 113 of cracked portion 114 may be in the form of bridges that connect inner walls 113 of cracked portion 114 or may be in the form of tips that protrude from inner walls 113 of cracked portion 114. In addition, the acicular materials in the form of bridges and the acicular materials in the form of tips may be formed together between the inner walls of cracked portion 114. In other words, the acicular materials in the form of bridges and the acicular materials in the form of tips may co-exist in the same cracked portion 114.

In the field emission device having the structure described above, when a predetermined electric field is applied between first electrode 120 constituting a cathode and second electrode 140 constituting a gate electrode, electrons are emitted from electron emission source 111 formed on first electrode 120. In this regard, nano-sized acicular materials 115 are exposed between the inner walls 113 of cracked portion 114 formed in electron emission source 111 to improve electron emission properties. In addition, the emitted electrons collide with a phosphor layer formed on an anode disposed apart from the field emission device at a constant distance, thereby emitting light.

The present invention will now be described in more detail with reference to the examples below. However these examples are for illustrative purposes only and are not intended to limit the scope of the invention.

PE 320 used in Preparation Example and Comparative Preparation Example below is used as an oligomer and is a commercially available epoxy acrylate oligomer (n=3, number average molecular weight of 100 to 2,000) available from Miwon Commercial Co., Ltd. TPD is used as an initiator and is a commercially available acrylphosphine oxide available from Sartomer company. HSP188 is used as an initiator and is a commercially available benzophenone photoinitiator available from SK UCB Co., Ltd. PU600 is used as an oligomer and is a commercially available urethane acrylate oligomer available from Miwon Commercial Co., Ltd.

CD 9051 is an adhesion improver and is a commercially available trifunctional acid ester available from Sartomer company, for improving adhesion of a composition for forming an electron emission source to the surface of a substrate.

Preparation Example 1

Preparation of Composition for Forming Electron Emission Source 30 g of polyacrylate, as a binder, having a number average molecular weight of 350,000, 70 g of PE 320 (Miwon Commercial Co., Ltd.), 15 g of PETIA, 15 g of CD 9051, 7 g of TPO, 7 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source. CD 9051 is an adhesion improver, and is trifunctional acid ester produced by Sartomer Company, Inc., Exton, Pa., for improving adhesion in the composition for forming electron emission source.

Preparation Example 2

Preparation of Composition for Forming Electron Emission Source 30 g of polyacrylate, as a binder, having a number average molecular weight of 350,000, 70 g of PE 320, 15 g of PETIA, 0 g of CD 9051, 2.7 g of TPO, 2.7 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 3

Preparation of Composition for Forming Electron Emission Source 30 g of polyacrylate, as a binder, having a number average molecular weight of 350,000, 30 g of PE 320, 15 g of PETIA, 15 g of CD 9051, 7 g of TPO, 7 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 4

Preparation of Composition for Forming Electron Emission Source 50 g of polyacrylate, as a binder, having a number average molecular weight of 350,000, 50 g of PE 320, 15 g of PETIA, 7 g of CD 9051, 7 g of TPO, 7 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 5

Preparation of Composition for Forming Electron Emission Source 30 g of polyacrylate, as a binder, having a number average molecular weight of 350,000, 70 g of PE 320, 15 g of PETIA, 15 g of CD 9051, 2 g of TPO, 2 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 6

Preparation of Composition for Forming Electron Emission Source 30 g of polyacrylate, as a binder, having a number average molecular weight of 350,000, 70 g of PE 320, 4 g of PETIA, 15 g of CD 9051, 7 g of TPO, 7 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 7

Preparation of Composition for Forming Electron Emission Source

A composition for forming an electron emission source was prepared in the same manner as in Preparation Example 1, except that PU 600 (Miwon Commercial Co., Ltd.) was used instead of PE 320.

Preparation Example 8

Preparation of Composition for Forming Electron Emission Source 30 g of polyacrylate, as a binder, having a number average molecular weight of 350,000, 70 g of PE 320, 4 g of PETIA, 15 g of CD 9051, 20 g of TPO, 20 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Preparation Example 9

Preparation of Composition for Forming Electron Emission Source

A composition for forming an electron emission source was prepared in the same manner as in Preparation Example 8, except that PU600 was used instead of PE320.

Comparative Preparation Example 1

Preparation of Composition for Forming Electron Emission Source 30 g of polyacrylate, as a binder, having a number average molecular weight of 350,000, 70 g of PE 320, 4 g of PETIA, 15 g of CD 9051, 0 g of TPO, 0 g of HSP188, 10 g of CNT, and 20 g of $SnO_2$ as a filler were added to 20 g of terpineol as a solvent, and the mixture was stirred at 10,000 rpm for 30 minutes. The resulting mixture was mixed by three roll milling for 2 hours to prepare a well dispersed composition for forming an electron emission source.

Comparative Preparation Example 2

Preparation of Composition for Forming Electron Emission Source

A composition for forming an electron emission source was prepared in the same manner as in Comparative Preparation Example 1, except that 1 g of TPO and 1 g of HSP188 were used.

Comparative Preparation Example 3

Preparation of Composition for Forming Electron Emission Source

A composition for forming an electron emission source was prepared in the same manner as in Comparative Preparation Example 1, except that PU600 was used instead of PE320.

Comparative Preparation Example 4

Preparation of Composition for Forming Electron Emission Source

A composition for forming an electron emission source was prepared in the same manner as in Comparative Preparation Example 2, except that PU600 was used instead of PE320.

Example 1

Manufacture of Field Emission Device

The composition for forming an electron emission source prepared in Preparation Example 1 was printed on an electron emission source forming region on a substrate on which a Cr gate electrode, an insulating film, and an ITO electrode were stacked, and then dried at a temperature of 120° C. for 20 minutes. The dried composition was exposed to UV light having a light exposure energy of about 8 J/cm$^2$.

Subsequently, the resultant was heat treated at a temperature of about 450° C. for 30 minutes in a nitrogen gas atmosphere to prepare an electron emission source and a field emission device using the electron emission source.

Examples 2 Through 9

Manufacture of Field Emission Device

Electron emission sources and filed emission devices were prepared in the same manner as in Example 1, except that the compositions for forming an electron emission source prepared in Preparation Examples 2 through 9 were used instead of the composition for forming an electron emission source of Preparation Example 1.

Comparative Example 1

Manufacture of Filed Emission Device

The composition for forming an electron emission source prepared in Comparative Preparation Example 1 was printed on an electron emission source forming region on a substrate on which a Cr gate electrode, an insulating film, and an ITO electrode were stacked, and then dried at a temperature of 120° C. for 20 minutes. The dried composition was exposed to light having a light exposure energy of about 8 J/cm$^2$.

Subsequently, the resultant was heat treated at a temperature of about 450° C. for 30 minutes in a nitrogen gas atmosphere. After the heat treatment process, an activation treatment using a tape was performed on the resultant to prepare an electron emission source and a field emission device.

Comparative Examples 2-4

Manufacture of Field Emission Device

Electron emission sources and field emission sources were prepared in the same manner as in Comparative Example 1, except that the composition for forming an electron emission source prepared in Comparative Preparation Examples 2 to 4 were respectively used instead of the composition for forming an electron emission source of Comparative Preparation Example 1.

By using an optical microscope, it was determined whether the electron emission sources of Examples 1 through 9 and Comparative Examples 1 through 4 were cracked. The results are shown in Table 1 below.

TABLE 1

| | Degree of Cracking |
|---|---|
| Example 1 | ◎ |
| Example 2 | ○ |
| Example 3 | ○ |
| Example 4 | ○ |
| Example 5 | ○ |
| Example 6 | ◎ |
| Example 7 | ◎ |
| Example 8 | ◎ |
| Example 9 | ◎ |
| Comparative Example 1 | X |
| Comparative Example 2 | X |
| Comparative Example 3 | X |
| Comparative Example 4 | X |

In Table 1, the degree of cracking was represented by the symbols x, ○, and ◎ according to an evaluation standard below.

Evaluation Standard

1. If there are 2 cracks or less within 100 um×100 um: x
2. If there are 3 to 6 cracks within 100 um×100 um: ○
3. If there are 7 cracks or more within 100 um×100 um: ◎

A lot of cracks occurred in the electron emission source of Examples 8 and 9 and the electron emission source of Comparative Examples 4 and 5, compared with the electron emission sources of Comparative Examples 1 and 2. The storage stability of the composition for forming an electron emission source of Preparation Example 8 was, however, poor, and thus, the composition was cured within 24 hours even while refrigeration stored. But, the composition for forming an electron emission source of Preparation Examples 8 and 9 could still be used in preparing an electron emission source despite its poor storage stability. Therefore, the comparative examples are not intended to limit the scope of the invention.

Figure 4:
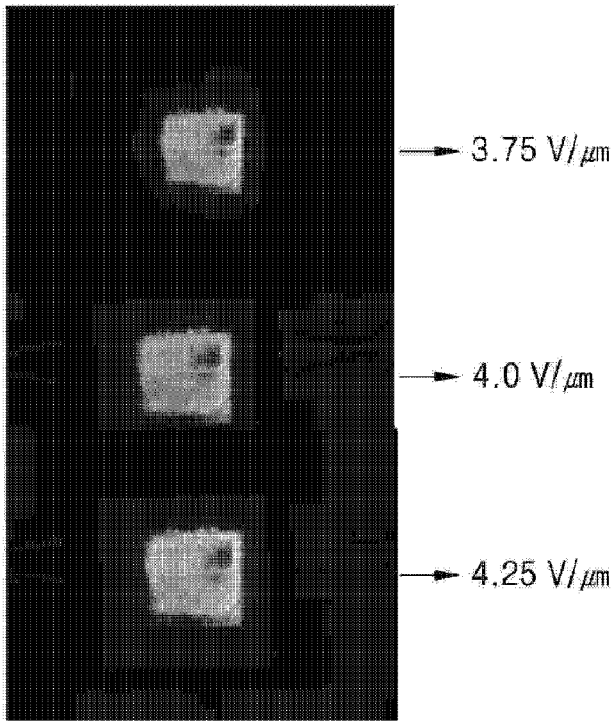
FIG. 4 shows phosphor luminescent images of emission caused by the collision of the electrons with a phosphor layer formed on an anode electrode in a field emission device prepared according to Example 7 obtained using a digital camera.

The field emission device prepared according to Example 7 is applied in a field emission display device constructed with a phosphor layer formed on an anode of the field emission display device. Electrons emitted from the field emission device collide with the phosphor layer to form images of emission. FIG. 4 shows the images of emission caused by the collision of the electrons with the phosphor layer formed on the anode electrode in the field emission device prepared according to Example 7 obtained by using a digital camera. The three emission images shown in FIG. 4 are obtained in the same area (2 cm×2 cm by size) when respective electric field of of 3.75 V/μm, 4.0V/μm, and 4.25 V/μm are applied to the anode.

Referring to FIG. 4, it was confirmed that electrons were uniformly emitted from the entire emission area, and the higher the higher the applied electric field, the brighter the image.

Figure 5A:
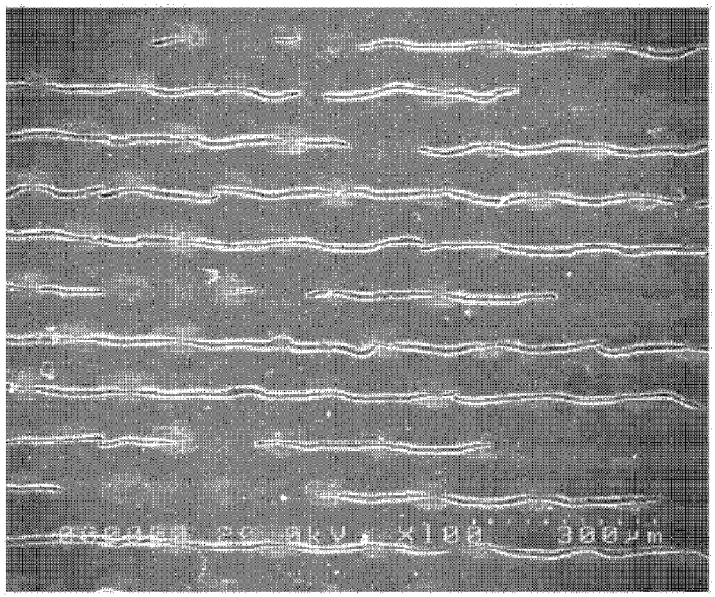
FIGS. 5 through 7 are scanning electron microscopic (SEM) images of an electron emission source prepared in Example 1 according to the principles of the present invention.
Figure 5B:
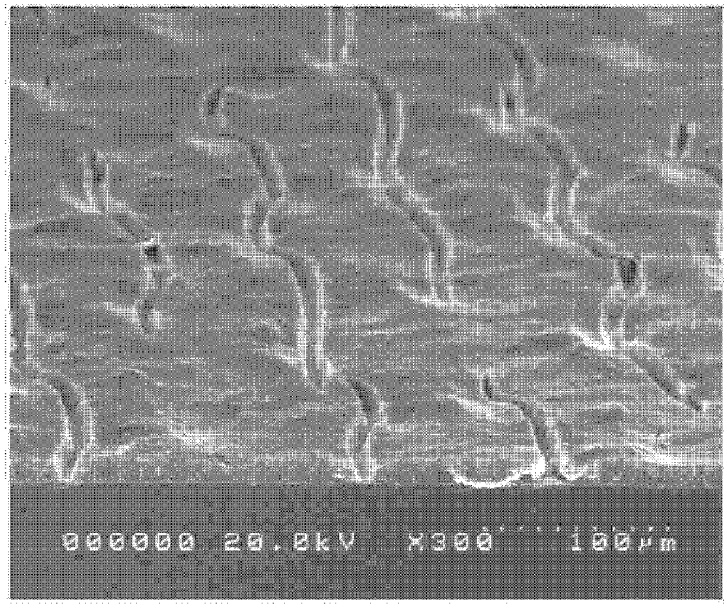
Figure 5C:
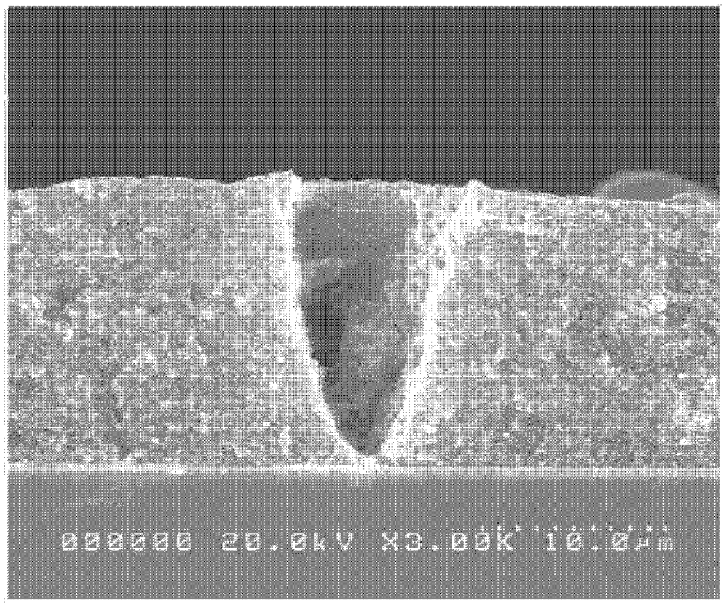
Figure 6:
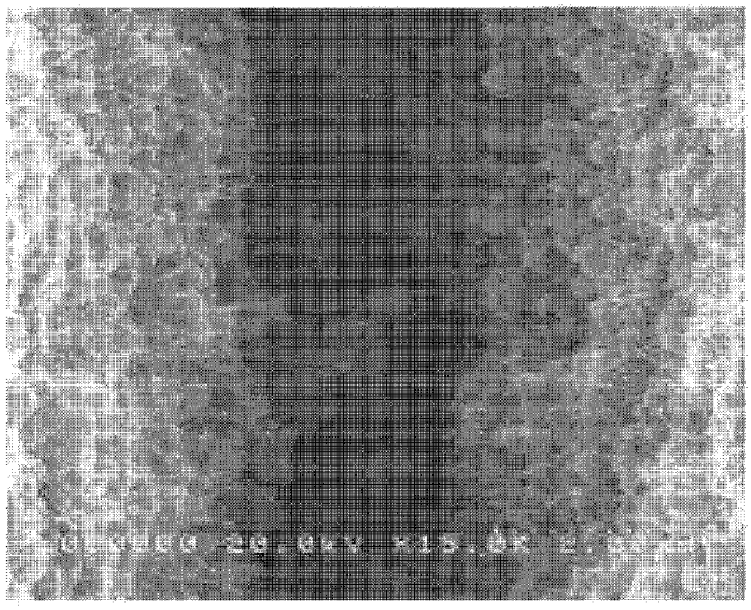
Figure 7:
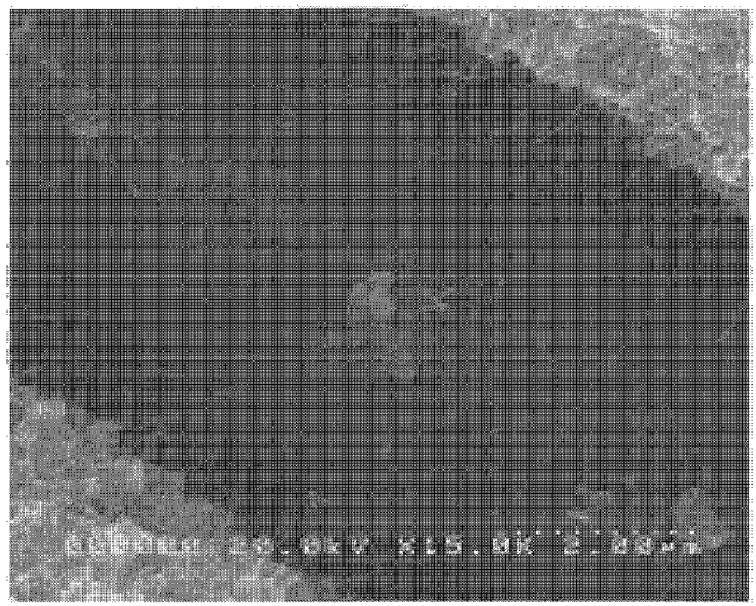

FIGS. 5 through 7 are scanning electron microscopic (SEM) images of cracks formed on a surface of a CNT in the electron emission source prepared in Example 7, wherein the images were observed at a low magnification of 100× to a high magnification of 15,000×.

FIGS. 5A through 5C are a scanning emission microscope (SEM) image showing a region of FIG. 4 at a low magnification. Referring to FIGS. 5A through 5C, it was confirmed that cracks are uniformly formed on the entire emission area. FIG. 6 is a SEM image of a portion where a small crack is formed in a region of FIG. 5 at a high magnification. FIG. 7 is a SEM image of a portion where a big crack is formed in a region of FIG. 5 at a high magnification.

Referring to FIG. 6, the crack is smaller than that of FIG. 7. Thus, the cracked portion of FIG. 6 has a CNT net having a bridge structure that connects two non-microcrack regions. That is, the bridge structure of the CNT net shown in FIG. 6 connects the inner walls of the microcrack regions. Referring to FIG. 7, the crack is larger than that of FIG. 6. Thus, the cracked portion of FIG. 7 has a CNT tip structure that protrudes from the inner walls of the non-microcrack region.

Figure 8:
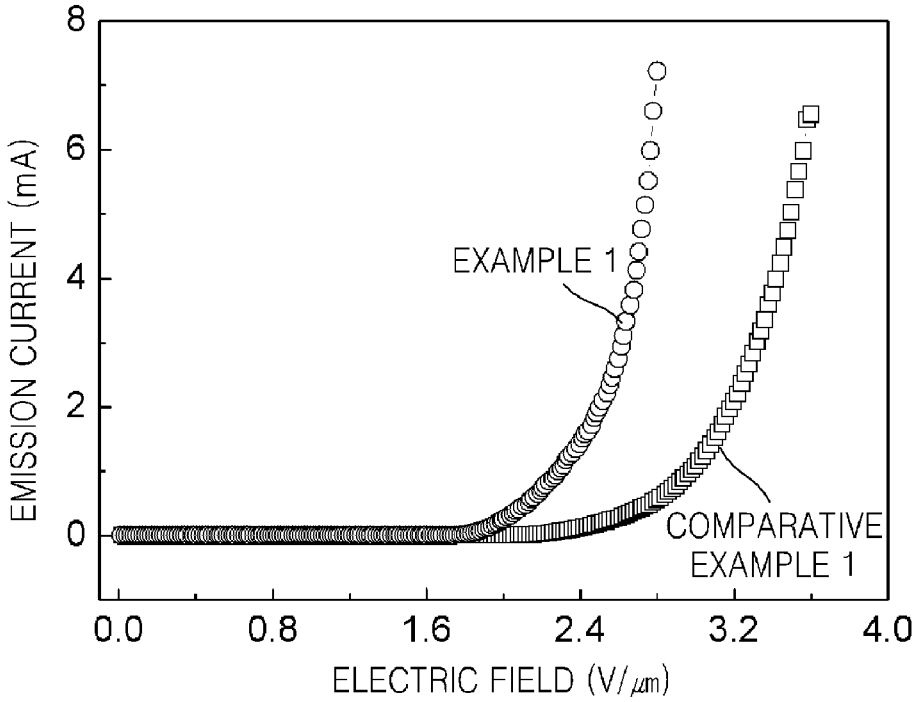
FIG. 8 is a graph showing a change in emission current with respect to an applied electric field, of the field emission devices manufactured in Example 1 and Comparative Example 1.

FIG. 8 is a graph showing a change in emission current, with respect to an applied electric field, of the field emission devices manufactured in Example 1 and Comparative Example 1. In this regard, the emission current is measured after an anode substrate coated with phosphor is disposed apart from a cathode substrate on which the electron emission source is formed at a distance of 0.5 mm, and then the cathode substrate is grounded while a voltage applied to the anode substrate is increased.

Referring to FIG. 8, the field emission device of Example 1 has excellent emission properties, compared with the field emission device of Comparative Example 1.

Figure 9:
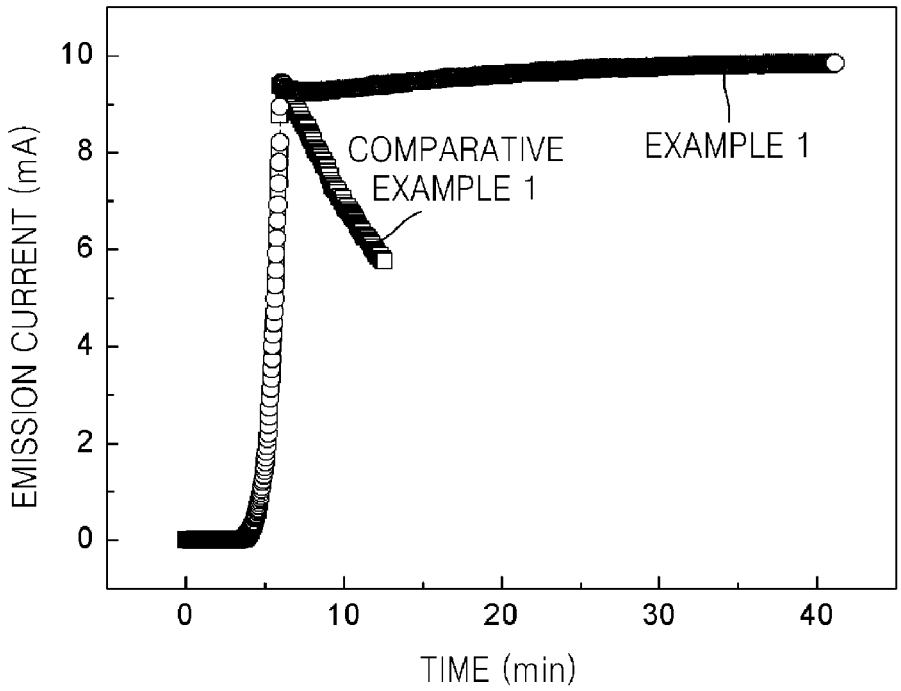
FIG. 9 is a graph showing a change in emission current characteristics with respect to time, of the field emission devices manufactured in Example 1 and Comparative Example 1.

FIG. 9 is a graph showing a change in emission current characteristics, according to time, of the field emission devices manufactured in Example 1 and Comparative Example 1. In this regard, the stability of emission current characteristics is measured using almost the same method as that used to measure the emission current characteristics of FIG. 8, but is evaluated by measuring a change in emission current in a state that is maintained after a maximum voltage is applied.

Referring to FIG. 9, the field emission device of Example 1 has significantly improved emission current stability, compared with the field emission device of Comparative Example 1.

As described above, according to the one or more above embodiments, an electron emission source with low turn-on voltage and improved emission properties and emission current stability can be prepared even when a post-treatment process, such as an activation process using a tape, is not performed, and a field emission device including the electron emission source can be manufactured.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A composition for forming an electron emission source, comprising:

an acicular material;

an oligomer; the oligomer being a urethane acrylate oligomer;

a crosslinkable monomer; where the crosslinkable monomer is a bifunctional acrylate or a higher functional acrylate than a bifunctional acrylate;

an initiator; and a solvent, with the amount of the crosslinkable monomer being in the range of about 5 to about 50 parts by weight based on 100 parts by weight of the oligomer.

2. The composition of claim 1, with the amount of the initiator being in the range of 5 parts to 50 parts by weight based on 100 parts by weight of the oligomer.

3. The composition of claim 1, with the amount of the initiator being in the range of 5 parts to 20 parts by weight based on 100 parts by weight of the oligomer.

4. The composition of claim 1, with the amount of the initiator being about 20 parts by weight based on 100 parts by weight of the oligomer.

5. The composition of claim 1, with the acicular material comprising carbon nanotubes or nanowires.

6. The composition of claim 1, with the amount of the acicular material being in the range of about 1 to about 40 parts by weight based on 100 parts by weight of the oligomer.

7. The composition of claim 1, further comprising at least one selected from a binder resin and a filler.

8. The composition of claim 1, further comprising a binder resin, with the amount of the binder resin being in the range of about 0.1 to 250 parts by weight based on 100 parts by weight of the oligomer.

9. The composition of claim 1, further comprising a filler, with the amount of the filler being in the range of about 10 to about 100 parts by weight based on 100 parts by weight of the oligomer.

10. The composition of claim 1, wherein the amount of the initiator is in the range of 5.71 parts to 200 parts by weight based on 100 parts by weight of the oligomer.

11. The composition of claim 1, wherein the crosslinkable monomer is propane-1,3-diol-2,2-bis (hydroxymethyl) triacrylate (penta-erythritol tri-acrylate, PETIA), or trimethylolpropane triacrylate (TMPTA).

12. The composition of claim 1, with the amount of the initiator being not less than 5 parts by weight based on 100 parts by weight of the oligomer.

13. A composition for forming an electron emission source, comprising:

an acicular material;

an oligomer;

a crosslinkable monomer; where the crosslinkable monomer is a bifunctional acrylate or a higher functional acrylate than a bifunctional acrylate;

an initiator; and a solvent, with the amount of the crosslinkable monomer being in the range of about 5 to about 50 parts by weight based on 100 parts by weight of the oligomer.

14. The composition of claim 13, wherein the oligomer is a (meth)acrylate-based compound having a viscosity of 1,000 cps at 25° C. or greater.

15. The composition of claim 13, with the oligomer being epoxy acrylate oligomer or urethane acrylate oligomer.

16. The composition of claim 13, with the crosslinkable monomer being propane-1,3-diol-2,2-bis (hydroxymethyl) triacrylate (penta-erythritol tri-acrylate, PETIA), or trimethylolpropane triacrylate (TMPTA).

17. The composition of claim 13, with the amount of the initiator being not less than 5 parts by weight based on 100 parts by weight of the oligomer.

18. The composition of claim 13, with the amount of the initiator being not less than 5 parts by weight based on 100 parts by weight of the oligomer.

19. A composition for forming an electron emission source, comprising:

an acicular material;

an oligomer; the oligomer being a urethane acrylate oligomer or epoxy acrylate oligomer;

a crosslinkable monomer; the crosslinkable monomer being propane-1,3-diol-2,2-bis (hydroxymethyl) triacrylate (penta-erythritol tri-acrylate, PETIA), or trimethylolpropane triacrylate (TMPTA);

an initiator; and a solvent, with the amount of the initiator being not less than 5 parts by weight based on 100 parts by weight of the oligomer; and with the amount of the crosslinkable monomer being in the range of about 5 to about 50 parts by weight based on 100 parts by weight of the oligomer.

* * * * *